US005261657A

United States Patent [19]

Edin

[11] Patent Number: 5,261,657

[45] Date of Patent: Nov. 16, 1993

[54] DOCUMENT TRANSPORT ARRANGEMENT WITH RELAY-ACTIVATED DOCUMENT GRIPPING DEVICE INCLUDING COACTING RELAY ARMATURE RETURN

[75] Inventor: Gösta Edin, Rönninge, Sweden

[73] Assignee: Inter Innovation AB, Stockholm, Sweden

[21] Appl. No.: 28,525

[22] Filed: Mar. 9, 1993

[51] Int. Cl.[5] ..... B65H 5/06

[52] U.S. Cl. ..... 271/274; 271/225; 271/184

[58] Field of Search ..... 271/184, 225, 273, 274

[56] References Cited

U.S. PATENT DOCUMENTS

| | | | |
|---|---|---|---|
| 3,936,993 | 2/1976 | Dorer | 271/184 |
| 4,051,957 | 10/1977 | Parups | 271/184 |
| 4,061,329 | 12/1977 | Sachuk et al. | 271/225 |
| 4,500,086 | 2/1985 | Garavuso | 271/184 |
| 4,650,178 | 3/1987 | Steele et al. | 271/184 |
| 4,736,852 | 4/1988 | Edin et al. . | |
| 4,757,903 | 7/1988 | Edin | 271/225 |
| 4,802,665 | 2/1989 | Allio et al. | 271/184 |
| 5,080,347 | 1/1992 | Funada | 271/274 |

FOREIGN PATENT DOCUMENTS

| | | | |
|---|---|---|---|
| 0346220 | 12/1989 | European Pat. Off. . | |
| 358199 | 3/1990 | European Pat. Off. | 271/184 |
| 1436061 | 3/1970 | Fed. Rep. of Germany . | |
| 3422739 | 12/1984 | Fed. Rep. of Germany . | |
| 2195617 | 4/1988 | United Kingdom . | |

*Primary Examiner*—H. Grant Skaggs
*Assistant Examiner*—Carol L. Druzbick
*Attorney, Agent, or Firm*—Simmons, Perrine, Albright & Ellwood

[57] ABSTRACT

An arrangement in an automatic document-handling apparatus for transporting large numbers of documents at high speeds includes first and second transportation paths for the transportation of documents in the direction of their long axes and transverse axes, respectively, and a gripping device for moving documents from the first to the second of these paths. This gripping device includes a firmly mounted, rotatable drive device, and a moveably mounted, relay-activatable co-rotating device rotating together with the drive device when in engagement therewith. The relay is inactive when moving a document between the transportation paths and becomes active upon completion of one revolution of the corotating device. This device is moved into engagement with the drive device, when the relay switches from its active to its inactive state.

5 Claims, 1 Drawing Sheet

DOCUMENT TRANSPORT ARRANGEMENT WITH RELAY-ACTIVATED DOCUMENT GRIPPING DEVICE INCLUDING COACTING RELAY ARMATURE RETURN

This is a continuation of application Ser. No. 07/842,053, filed Feb. 25, 1992 now abandoned.

The present invention relates to an arrangement in an automatic document-handling machine for transporting of valuable documents, such as banknotes, cheques, etc. The arrangement is of the kind which includes, among other things, a first transportation path for the transportation of valuable documents in a first part of the automatic document-handling machine, a second transportation path for transporting valuable documents in a second part of said machine, and a gripping device for moving valuable documents from the first transportation path to the second transportation path and which includes a firmly mounted but rotating drive device and a moveably mounted, relay-activated device which corotates with the drive device when in engagement therewith.

An arrangement of this kind is known from, e.g., U.S. Pat. No. 4,736,852, which corresponds to Swedish Patent Specification No. 446,567. Thus, there is included in a first part of this arrangement a first transportation path by means of which banknotes are transported from an infeed opening to a gripping device, while included in a second part of the arrangement is a second transportation path by means of which banknotes are transported from the gripping device to a cassette-accommodating space, or to an outfeed opening. The gripping device includes a relay (solenoid) which in the transportation of banknotes from the first transportation path to the second transportation path is operative to bring two transportation rollers to a position of mutual coaction such as to change the direction of transportation of a banknote located between the rollers, namely from transportation in the length direction of the banknote (one short side first) to transportation at right angles to the long axis of the banknote (one long side first). The relay activation period is adapted so that the rollers will remain active over a period of time of sufficient duration to ensure that the banknote will be transported to the second transportation path.

In order to be able to capture a banknote, for instance in an automatic currency dispenser, during its transportation in its length direction and to position the banknote precisely during its transportation at right angles to its length direction, it is necessary to equip the dispenser with relays provided with small magnets and having high power outputs. In the case of automatic dispensers which are used for transactions that include at most about 100 banknotes and with which there is a period of inactivity between consecutive transactions, no problems will normally occur, since the magnets will have time to cool between transactions. In automatic dispensers of greater capacity, in which each transaction may include up to about 2,000 banknotes, there is a danger that the magnets will overheat, resulting in a breakdown in or malfunction of the dispenser.

An object of the present invention is to eliminate the aforesaid drawback, among other things.

In an arrangement of the aforesaid kind, comprising two transportation paths and a gripping device mounted between said paths and including a firmly mounted but rotating drive device and a moveably mounted, relay-activated device which co-rotates with the drive device when in engagement therewith, the relay is constructed to adopt an inactive state at the time when movement of a banknote from the first to the second transportation path takes place, and to return to an active state when the co-rotating device has rotated through one revolution. The co-rotating device is arranged to be moved towards the drive device as the relay switches from its active state to its inactive state, such that a predetermined part of the circumference of said co-rotating device will engage the drive device. This arrangement enables the power requirement of the relay to be reduced to only some few percent of the power required for a corresponding relay which is in an active state during operation of the arrangement.

According to one development of the invention, the corotating device is arranged to steer movement of the relay armature during the transition of the relay from its inactive to its active state, as said co-rotating device moves and rotates.

The invention will now be described in more detail with reference to the accompanying schematic drawings, in which FIG. 1 illustrates a gripping device included in the inventive arrangement or dispenser in a rest position, with its relay in a working state (its active state);

Figure 1:
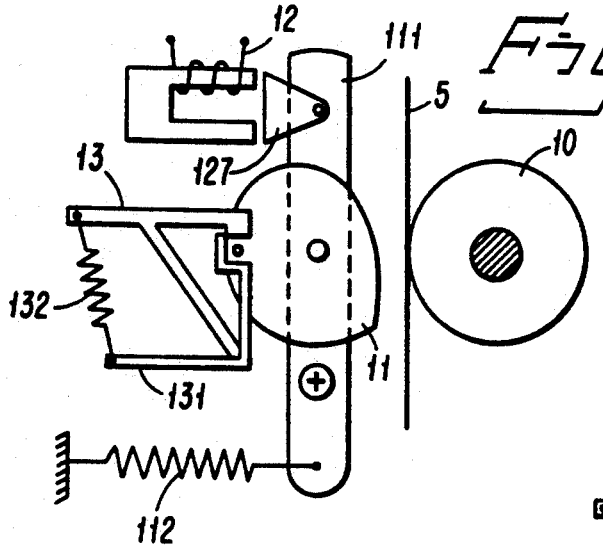

The gripping device illustrated in FIG. 1 includes a firmly mounted but rotatable drive device 10, a moveably mounted, relay-activated device 11 which rotates together with the drive device 10 during a working function, a relay 12 having a moveable armature 121 which is attached to one end of a lever arm 111 which carries the co-rotating device 11 and the bottom end of which is actuable by a draw spring 112, and a latching device 13 which includes a moveably mounted and spring-activated latching arm 131.

Located between the drive device 10 and the co-rotating device 11 is a banknote S which is held in position between the devices 10 and 11 while being transported in a first transportation path perpendicularly to the plane of the drawing, by means of bands or rollers, not shown.

Figure 2:
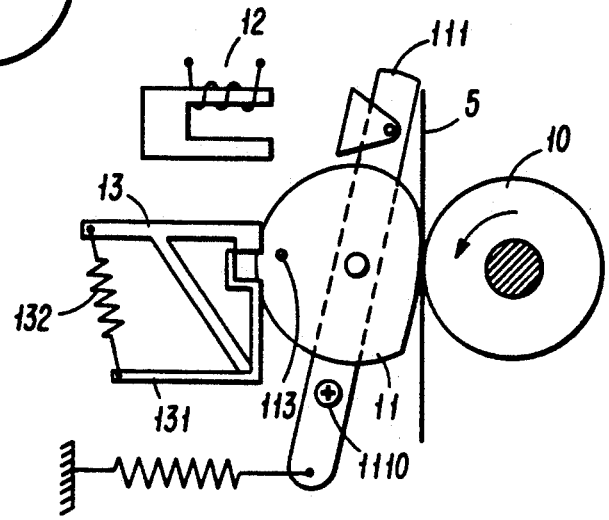
FIG. 2 illustrates the gripping device of FIG. 1 in a working position, with the relay in a rest state (its inactive state)

FIG. 2 illustrates the functional state of the arrangement at precisely that moment when the gripping device illustrated in FIG. 1 has received a signal to the effect that the banknote S shall be moved from the first transportation path to a second transportation path in the dispenser. In the illustrated case, supply current to the relay 12 has been interrupted, the lever arm 111 together with the armature 121 and the co-rotating device 11 has been rotated clockwise about the lever arm axis 1110 and clockwise rotation of the drive device 10 has been initiated.

The banknote S has reached the position in which its centrepoint is located opposite to the devices 10–11, during movement of said banknote at right angles to the plane of the drawing.

The banknote S will be moved downwards, as a result of the mutual coaction between the devices 10 and 11. The drive device 10 has a circular, outer peripheral surface (drive surface), whereas the co-rotating device 11 has an arcuate outer surface which extends through an angle of arc of about 190° of its periphery and an outer surface of continually varying radius around the remaining approximately 170° of its periphery.

In the operational state of the arrangement shown in FIG. 2, the co-rotating device 11 has just come into contact with the banknote S and the drive device 10 at that part of the outer surface of the co-rotating device which has the smallest centre-radius. A pin 113 provided on the co-rotating device 11, said pin in the FIG. 1 illustration being latched in the latching device 13, is located roughly opposite the contact point (the surface) with the banknote S.

Figure 3:
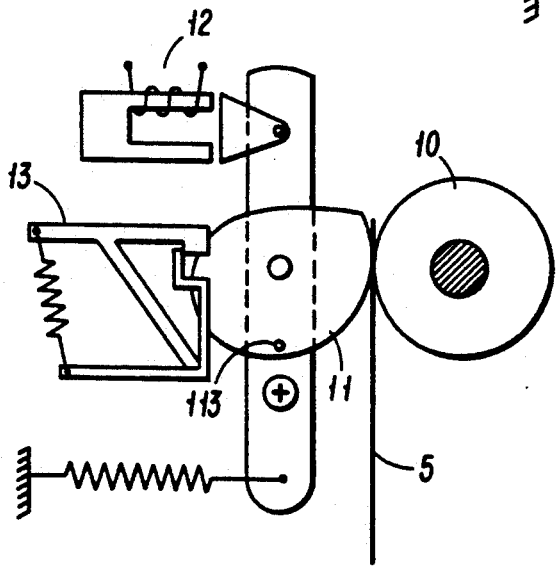
FIG. 3 illustrates the gripping device of FIG. 1 and shows the relay in its working state (its active state), with the co-rotating device still in coacting engagement with a drive device.

In the operational state illustrated in FIG. 3, the corotating device 11 has been rotated clockwise through an angle of about 270°, while its coaction with the drive device 10 has resulted in displacement of the device to the left, thereby bringing the armature 121 into close proximity with the magnet of the relay 12, and the banknote S has been moved downwards some distance by rotation of the devices 10–11.

Figure 4:
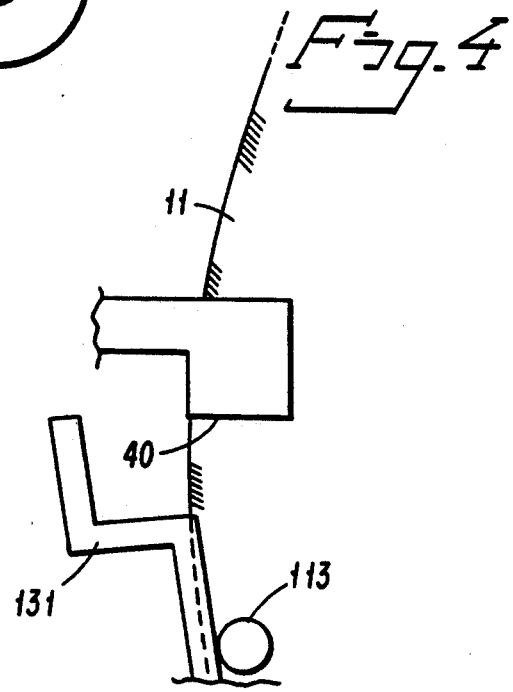
FIG. 4 illustrates part of a latching device which coacts with the co-rotating device.

Further rotational movement of the devices 10–11 causes the banknote S to move further downwards and the pin 113 will strike against the moveable latching arm 131 of the latching device 13, see FIG. 4, causing the latching arm to be moved successively to one side as the pin approaches the position illustrated in FIG. 1. When the pin 113 releases its contact with the latching arm 131, the pin strikes against a surface 40 on the latching device and the arm 131 is rotated by a spring 132 to the position shown in FIGS. 1 to 3. The pin 113 is therewith unable to move upwards or downwards, and the co-rotating device 11 is located in a well-defined home position. During movement of the co-rotating device 11 from the position shown in FIG. 3 to the position shown in FIG. 1, the device is out of contact with the drive device 10 during about the last half of its movement; it is the kinetic energy prevailing in said device which ensures completion of this movement. Current is again supplied to the coil of the relay 12 (this occurs approximately in the operational state shown in FIG. 3), the drive device 10 is stopped and the gripping device is again in its rest position in readiness to receive a further impulse for movement of the next banknote.

It will be understood that many modifications are conceivable within the scope of the inventive concept defined in claim 1. For example, the co-rotating device 11 can be provided with an arcuate outer surface which extends around about 40° of its periphery nearest one side of the flat peripheral surface which includes an angle of about 50°, and with an outer surface containing an angle of about 270° with a continuously increasing radius in a region extending from the other side of the flat surface (minimum radius) to the circular surface.

I claim:

1. An arrangement in an automatic document-handling machine for transporting documents, the arrangement comprising drive means rotatably mounted in a fixed position and having a drive surface for contacting documents to be transported, co-rotating means for contacting the documents to be transported, the co-rotating means having an outer surface for moving documents in coacting engagement with the drive means and having a home position out of contact with the drive means, means mounting the co-rotating means for rotation and for movement toward and away from the drive means, the co-rotating means and drive means gripping documents between the drive surface of the drive means and the outer surface of the co-rotating means upon movement of the co-rotating means from the home position toward the drive means, and relay means having an armature attached to the mounting means for movement together with the movement of the mounting means, the relay means retaining the armature in an active position and restraining the mounting means from movement toward the drive means upon activation of the relay means to retain the co-rotating means out of contact with the drive means, the co-rotating means including means for moving the armature into the active position prior to the co-rotating means moving into the home position, whereby the relay means may be activated after the armature has been moved into the active position.

2. The arrangement according to claim 1, comprising latch means and means disposed on the co-rotating means for engaging the latch means to stop the rotation of the co-rotating means upon the co-rotating means having moved into the home position.

3. The arrangement according to claim 2, wherein the latch means comprises a striker plate and the means for engaging the latch means comprises pin means rotating with the rotation of the co-rotating means into contact with the striker plate to stop further rotation of the co-rotating means upon rotation of the co-rotating means into the home position, and a latching arm pivotally movable into the path of the pin means to latch the co-rotating means in the home position.

4. An arrangement in an automatic document-handling machine for transporting documents, the arrangement comprising:

drive means rotatably mounted in a fixed position and having a drive surface for advancing documents to be transported;

co-rotating means having an outer surface for contacting the drive means and the documents to be transported in coacting engagement with the drive means, the co-rotating means having a home position with the outer surface out of contact with the drive means;

means mounting the co-rotating means for rotation and for movement toward and away from the drive means, the co-rotating means, when moved toward the drive means, becoming disposed in contact with the drive means to grip documents between the outer surface of the co-rotating means and the drive surface of the drive means;

relay means including means for activating the relay means, and including a relay and an armature, the armature being attached to the mounting means for movement with the mounting means away from and toward the relay, the armature holding the co-rotating means from movement toward the drive means when the relay means is activated; and the co-rotating means further including means for moving the mounting means and the armature toward the relay, whereby rotation of the co-rotating means moves the armature into an active position adjacent the relay prior to the co-rotating means rotating into the home position and prior to the relay means becoming activated.

5. The arrangement according to claim 4, further comprising means for locating the co-rotating means in the home position, the locating means comprising a striker plate and a latching arm pivotally disposed with respect to the striker plate, and means disposed on the co-rotating means for engaging the striker plate when the co-rotating means is in the home position, the engaging means pivotally moving the latching arm during the rotation of the co-rotating means into the home position.

* * * * *